US005165549A

United States Patent [19]

Kanda et al.

[11] Patent Number: 5,165,549

[45] Date of Patent: Nov. 24, 1992

[54] GAS CURRENT CLASSIFYING SEPARATOR

[75] Inventors: Hitoshi Kanda, Yokohama; Toshiaki Sasaki, Abiko; Masayoshi Kato, Iruma; Satoshi Mitsumura, Tokyo, all of Japan

[73] Assignee: Canon Kabushiki Kaisha, Tokyo, Japan

[21] Appl. No.: 771,527

[22] Filed: Oct. 7, 1991

Related U.S. Application Data

[63] Continuation of Ser. No. 305,161, Feb. 2, 1989, abandoned.

[30] Foreign Application Priority Data

| | | | |
|---|---|---|---|
| Feb. 9, 1988 | [JP] | Japan | 63-29813 |
| Feb. 11, 1988 | [JP] | Japan | 63-29773 |
| Mar. 28, 1988 | [JP] | Japan | 63-71766 |

[51] Int. Cl.[5] ..... B04C 5/00; B07B 7/00

[52] U.S. Cl. ..... 209/144; 209/138; 209/145

[58] Field of Search ..... 209/144, 138, 139.2, 209/143, 145, 146, 148

[56] References Cited

U.S. PATENT DOCUMENTS

| | | | |
|---|---|---|---|
| 1,491,433 | 4/1924 | Stebbins | 209/138 |
| 2,252,581 | 8/1941 | Saint-Jacques | 209/144 |
| 2,739,708 | 3/1956 | Denovan et al. | 209/138 |
| 3,098,036 | 7/1963 | Neumann | 209/144 |
| 3,358,844 | 12/1967 | Klein et al. | 209/144 |
| 4,221,655 | 9/1980 | Nakayama et al. | 209/144 |
| 4,260,478 | 4/1981 | Hosokawa et al. | 209/144 X |
| 4,869,786 | 9/1989 | Hanke | 209/144 X |

FOREIGN PATENT DOCUMENTS 54-48378 4/1979 Japan .

*Primary Examiner*—Margaret A. Focarino
*Assistant Examiner*—Dean J. Kramer
*Attorney, Agent, or Firm*—Fitzpatrick, Cella, Harper & Scinto

[57] ABSTRACT

A separator for classifying powder with air current comprises at least a classifying chamber and an introducing section for introducing powder into the classifying chamber, a powder feeding inlet for feeding powder formed at the upper portion of the classifying chamber, a cone-shaped classifying plate with a high central portion formed at the lower portion of the classifying chamber, a coarse powder discharging outlet for discharging coarse powder provided at the lower brim outer periphery of the classifying plate, a fine powder discharging outlet for discharging fine powder provided at the central portion of the classifying plate, a gas inflower for dispersing powder by whirling gas provided at the upper outer periphery of the classifying chamber, and a gas inflow inlet for creating a whirling current of gas for classifying powder provided at the lower portion of the classifying chamber.

11 Claims, 7 Drawing Sheets

GAS CURRENT CLASSIFYING SEPARATOR

This application is a continuation of application Ser. No. 07/305,161 filed Feb. 2, 1989, now abandoned.

BACKGROUND OF THE INVENTION

1. Field of the Invention

This invention relates to a gas current classifying separator which is used for powder classification by causing the powder fed into a classification chamber to enter a high speed whirling vortex to be separated by centrifugation into a fine powder group and a coarse powder group (or medium powder group).

2. Related Background Art

When the powder starting material flowing into a classification chamber is fluidized in a whirl in said classification chamber, centrifugal force and air resistance force in the inward direction act on the respective particles of the powdery starting material, and the classification point is determined by the balance between the centrifugal force and the air resistance force.

At the outer periphery of the classification chamber, larger particles are whirled, while smaller particles whirl inside thereof. By providing powder discharging outlets respectively at the center and the outer periphery of the lower portion of the classifying chamber, the fine powder group and the coarse powder group can be collected separately (classification).

In such a classifying separator, it is important that the starting powder should be sufficiently dispersed within the classifying chamber to become primary particles in enhancing the classification precision.

As this kind of classifying separator, an Iitani system classifying separator or Kuracyclon has been proposed. However, in this type of classifying separator, it is very difficult to control the classification point, to and involves such problems such as poor dispersion and poor classification precision when there is high dust concentration. In order to solve such problems, various proposals have been made. For example, such proposals are disclosed in Japanese Patent Laid-open Applications Nos. 54-48378, 54-79870 or U.S. Pat. No. 4,221,655. As a classifying separator practically applied, there may be mentioned a commercially available classifying separator sold under the name of DS separator. In this kind of classifying separator, although it has become possible to control the classification point, since powder is fed through a cyclon section into the classifying chamber, the powder is concentrated before entering the classifying chamber, whereby dispersion of the powder tended to become insufficient. Accordingly, a low classification efficiency results. Referring now to FIG. 5 and FIG. 6 in the accompanying drawings, the prior art device is to be further explained.

FIG. 5 is a schematic view of the outer surface of the prior art device, and FIG. 6 a schematic sectional view of the prior art device.

In FIG. 5 and FIG. 6, the gas current classifying separator has a main casing 1, a lower casing 2 connected to the lower portion of said casing 1, and a hopper 3 at the lower portion of the lower casing 2. Internally of the main body casing 1 is formed a classification chamber 4. At the upper portion of the main body casing 1 stands a guide cylinder 10, and a feeding cylinder 9 is connected to the upper outer peripheral portion of said guide cylinder 10. At the bottom within the guide cylinder 10 is equipped a cone-shaped (umbrella-shaped) discharging guide plate 15 with a high central portion, and an annular inlet 11 is formed at the lower brim outer periphery of said discharging guide plate 15. At the bottom of the classifying chamber 4 is equipped a cone-shaped (umbrella-shaped) classifying plate 5 with a high central portion, and an annular coarse powder discharging outlet 6 is formed at the lower brim outer periphery of the classifying plate 5, and a fine powder discharging outlet 7 is formed at the central portion of the classifying plate 5. At the outer periphery of the lower surrounding wall of the classifying chamber 4, there is a gas inflow inlet 8 equipped for inflowing air. The air inflow inlet 8 is constituted generally of gaps between a plural number of blade-shaped louvers 14 (see FIGS. 15A and 15B). The direction of the air introduced through the gas inflow inlet 8 is controlled by the classification louvers 14 so as to be jetted out in the whirling direction of the powder material which descends under whirling in the classifying chamber 4. Said air disperses the powder material, and also accelerates the whirling speed of the powder material.

FIG. 4B shows a cross sectional view seen along III—III in FIG. 5 and FIG. 6. In such gas current classifying separator, the starting powder pressure delivered by gas current from the feeding cylinder 9 to the guide cylinder 10 descends whirling around the internal outer periphery of the guide cylinder 10 and flows whirling through the annular feeding inlet 11 into the classifying chamber 4. Within the classifying chamber 4, the powder is separated into a coarse powder group and a fine powder group through the centrifugal force acting on the respective particles. However, in the device of the prior art, since the starting powder is fed into the classifying chamber 4 while being concentrated at the inner wall of the guide cylinder, dispersion of the powder particles is insufficient, and the powder descends while drawing a spiral in band within the guide cylinder similar to a cyclone. Therefore a nonuniform concentration is fed into the classifying chamber, whereby it is difficult to obtain sufficient classification precision. When the fine powder forms an agglomerate, or when fine powder is attached to coarse powder, if dispersion is insufficient, fine powder increasingly tends to be mixed into the coarse powder group side. Further, if dispersion is insufficient, the dust concentration within the classifying chamber 4 becomes nonuniform, whereby the classification precision itself is worsened, thereby causing a problem that the classified product has a broad particle size distribution. This tendency is more marked as the particle size of the starting powder is finer. Particularly, when the powder is 10 $\mu$m or less, the classification precision is lowered.

Accordingly, as disclosed in Japanese Utility Model Laid-open Application No. 54-122477, it has been proposed to prevent mixing of the coarse powder with the fine powder discharged through the fine powder discharging outlet 7 to make the average particle size of fine powder smaller by enlarging the diameter of the guide plate, enlarging the diameter of the feeding inlet and elongating the distance to the fine powder discharging outlet 7.

However, also in such a classifying separator, dispersion of powdery material within the classifying chamber is insufficient, and agglomerates of fine powder tend to be mixed into coarse powder, whereby lowering in classification efficiency departs from the first object of increasing the treated amount.

SUMMARY OF THE INVENTION

The present invention has solved various problems as described above.

An object of the present invention is to provide a gas current classifying separator with good classification efficiency.

Another object of the present invention is to provide a gas current classifying separator capable of forming classified powder with sharp particle size distribution.

A further object of the present invention is to provide a gas current classifying separator which can control easily the classification point.

Still another object of the present invention is to provide a gas current classifying separator in which an agglomerate of fine powder is formed with difficulty.

A still further object of the present invention is to provide a gas current classifying separator having high treating capacity per unit time.

According to the present invention, there is provided a separator for classifying powder with air current, comprising at least a classifying chamber and an introducing means for introducing powder into said classifying chamber, a powder feeding inlet for feeding powder formed at the upper portion of said classifying chamber, a cone-shaped classifying plate with a high central portion formed at the lower portion of said classifying chamber, a coarse powder discharging a outlet for discharging coarse powder group provided at the lower brim outer periphery of said classifying plate, a fine powder group discharging outlet for discharging fine powder group provided at the central portion of said classifying plate, a gas inflowing means for dispersing powder by whirling of gas provided at the upper outer periphery of said classifying chamber, and a gas inflow inlet for creating a whirling current of gas for classifying powder provided at the bottom of said classifying chamber.

DETAILED DESCRIPTION OF THE PREFERRED EMBODIMENTS

Figure 1:
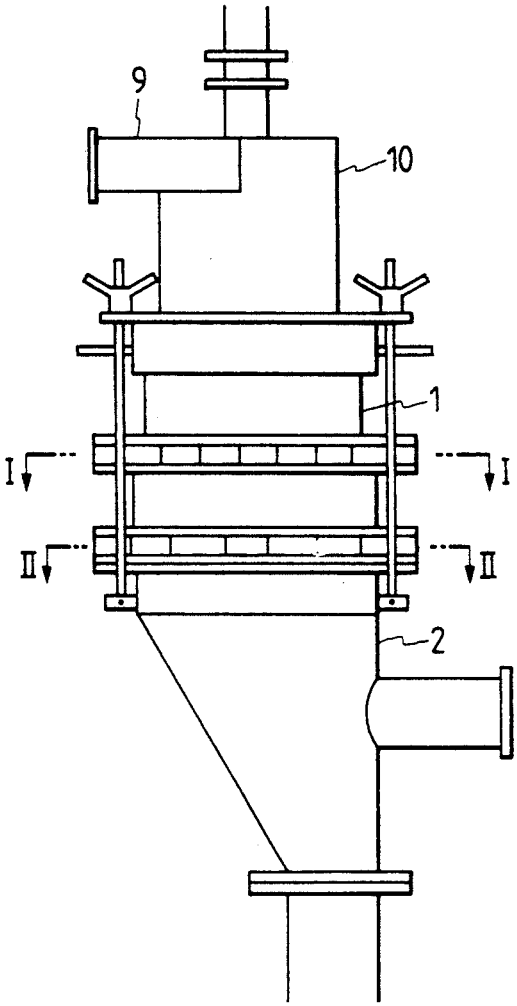
FIG. 1, FIG. 8 and FIG. 10 show schematic illustrations of the outer surface of the gas current classifying separator having practiced the device according to the present invention.

The gas current classifying separator of the present invention, in view of the problems of the prior art device as described above, is intended to improve dispersibility of the powder within the classifying chamber, thereby improving classification precision, by having a gas inflowing means for dispersing powder by whirling current to the upper outer periphery of the classifying chamber. The present invention is described below in detail by referring to the drawings.

Figure 2:
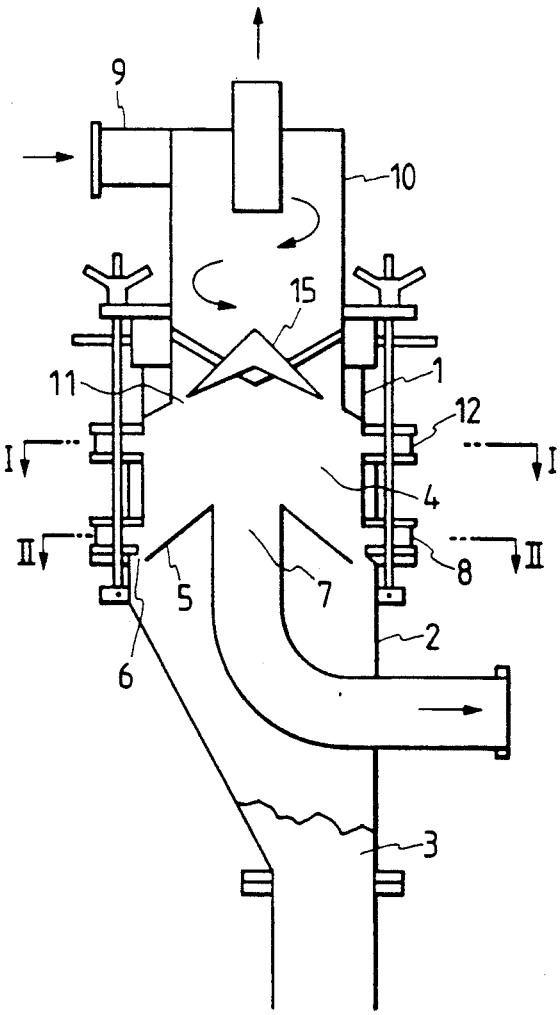
FIG. 2, FIG. 9, FIG. 11, FIG. 12, FIG. 13 and FIG. 14 show schematic longitudinal front views of said classifying separator.

As an example of the classifying separator according to the present invention, one of the system shown in FIG. 1 (schematic view showing the outer surface of the device) and FIG. 2 (schematic view showing longitudinal front view of the device) can be exemplified.

Figure 3:
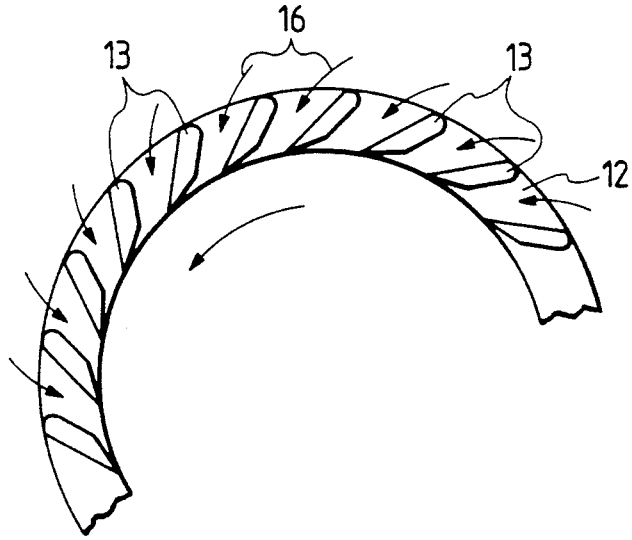
FIG. 3 shows a schematic sectional view seen along I—I in the classifying separator shown in FIG. 1, FIG. 8 or FIG. 10, FIG. 4A a schematic sectional view seen along II—II and FIG. 4B a schematic sectional view seen along III—III in the classifying separator shown in FIG. 5.

In FIG. 1 and FIG. 2, the classifying separator has a main body casing 1, a lower casing 2 connected to the lower portion of said casing 1, and a hopper 3 at the lower portion of the lower casing 2, with a classifying chamber 4 being formed internally of the main body casing 1. At the upper part of the main body casing 1 is standing a guide cylinder 10, and a feeding cylinder 9 is connected to the upper outer periphery of said guide cylinder 10. The guide cylinder 10 has a discharging guide plate 15 shaped in a cone (shaped in an umbrella) with a high central portion, and an annular powder feeding inlet 11 is formed at the lower brim outer periphery of the discharging guide plate 15. At the bottom of the classifying chamber 4, a classifying plate 5 shaped in a cone (shaped in an umbrella) with a high central portion is located, and an annular coarse powder discharging outlet 6 for discharging a coarse powder group is formed at the lower brim outer periphery of the classifying plate 5, and a fine powder discharging outlet 7 for discharging a fine powder group is formed at the central portion of the classifying plate 5. At the upper surrounding wall outer periphery of the classifying chamber 4, a gas inflowing inlet 12 is provided as the gas inflowing means for permitting a gas to inflow into the chamber. The means constituting said gas inflow inlet 12 may include, as a preferable example, gaps of a plural number of blade-shaped dispersing louvers 13. FIG. 3 shows a sectional view seen along I—I in FIG. 1 and FIG. 2. As shown in FIG. 3, the direction of the air flow 16 introduced through the gas inflowing inlet 12 is controlled by the dispersing louvers 13 so that the air may descend while whirling around the inner periphery of the guide cylinder 10 to be jetted out in the whirling direction of the powder material inflowing under whirling into the classifying chamber 4 through the annular feeding inlet 11. The gas inflowing means formed by the dispersing louvers 13 plays a role of making smaller the agglomerate of powder by dispersing positively the powder immediately after inflow into the classifying chamber 4, and further accelerating the powder. By this means, the classifying precision of powder is improved to a great extent.

Figure 4A:
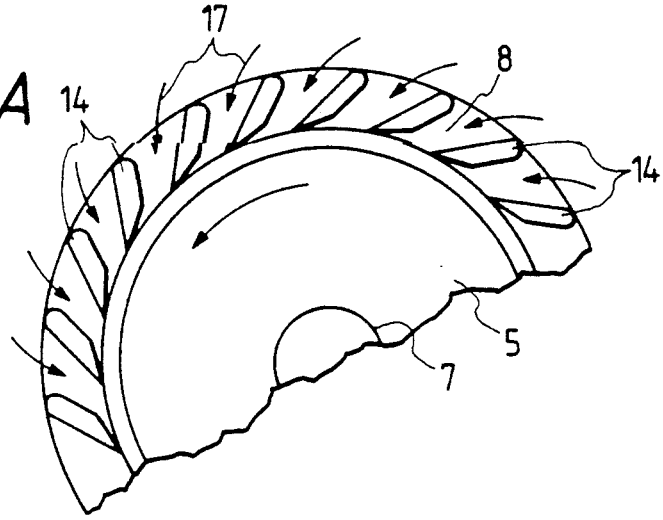

At the lower surrounding wall periphery of the classifying chamber 4, a gas inflowing inlet 8 for inflowing air is equipped. The gas inflowing inlet 8 includes gaps of a plural number of blade-shaped classifying louvers 14 as shown in FIG. 4*a*. The direction of the air flow 17 introduced through the gas inflowing inlet 8 is controlled by the classifying louvers 14 so that it may be jetted out in the whirling direction of the powder material descending through the classifying chamber 4 under whirling, so as to disperse again the powder material and accelerate the whirling speed.

The intervals between the classifying louvers 14 and the intervals between the dispersing louvers 13 are controllable, and the heights of the classifying louvers 14 and the dispersing louvers 13 can be also set suitably.

According to the constitution of the present invention, the powder material concentrated by centrifugal force against the inner wall of the guide cylinder 10 and entering through the annular feeding inlet 11 under whirling conditions into the classifying chamber 4 is dispersed by the air 16 flowing through the gas inflow inlet 12, and also accelerated in whirling force in the lower portion of the classifying chamber, and at the bottom of the classifying chamber. The whirling force is further accelerated by the air 17 flowing through the gas inflow inlet 8, whereby the powder is classified with good efficiency into a coarse powder group and a fine powder group. The dispersed state of the starting powder in the classifying chamber 4 affects very greatly the classification performance. In the conventional gas classifying separators, such dispersion was insufficient, while in the present invention, this problem is solved by providing a gas inflow inlet 12 at the upper portion of the classifying chamber. The gas inflowing inlet 12 provided at the upper portion of the classifying chamber should be preferably provided at the upper portion rather than the center of the classifying chamber 4, and preferably provided below the annular feeding inlet 11 (formed substantially of the outer brim portion of the discharging guide plate 15 and the inner wall of the main body casing). The wind velocity of the air 16 flowing through the inflow inlet 12 should be preferably controlled so as to be substantially equal to or slower than the wind velocity of the air 17 flowing through the gas inflow inlet 8 at the lower portion of the classifying chamber. This is based on the technical concept that the air 16 flowing through the gas inflow inlet 12 is primarily intended to disperse the particles in the powder, while the air 17 flowing through the gas inflow inlet 8 is introduced to give a strong whirling force to the particles and classifying the powder into a coarse powder group and a fine powder group through centrifugal force.

When the total sum of the opening area of the inflow inlet 12 is made A ($cm^2$) and the total sum of the opening area of the inflow inlet 8 is made B ($cm^2$), it is preferable for improvement of performance to control the opening areas so that A and B may satisfy the following formula: $1 \leqq A/B \leqq 20$. A specific feature of the present invention resides in providing an inflow inlet of a gas such as air at the upper portion of the classifying chamber, and the constitution of the bottom of said gas inflow inlet as shown in FIG. 1 and FIG. 2 can be changed within the range which does not impair the technical concept of the present invention.

Figure 8:
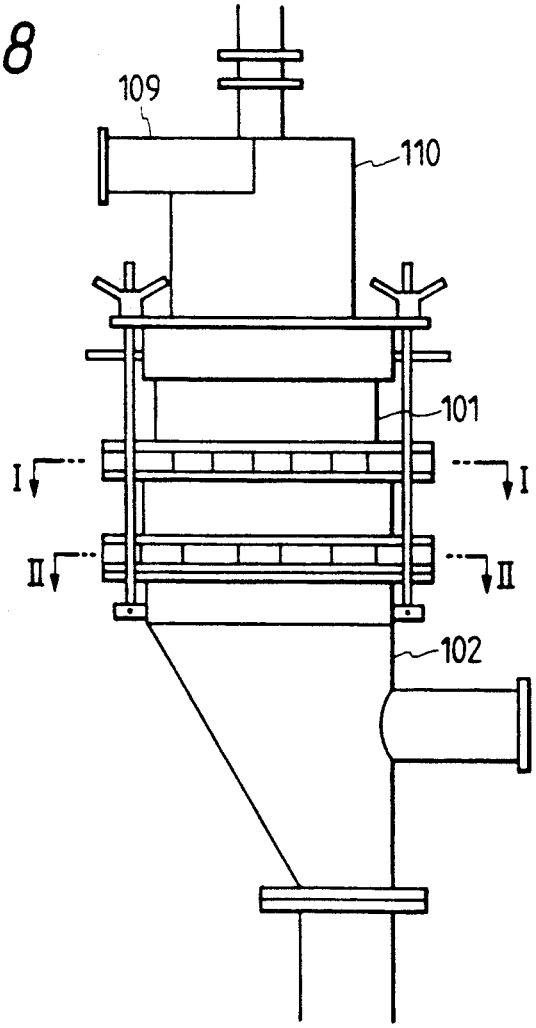
Figure 9:
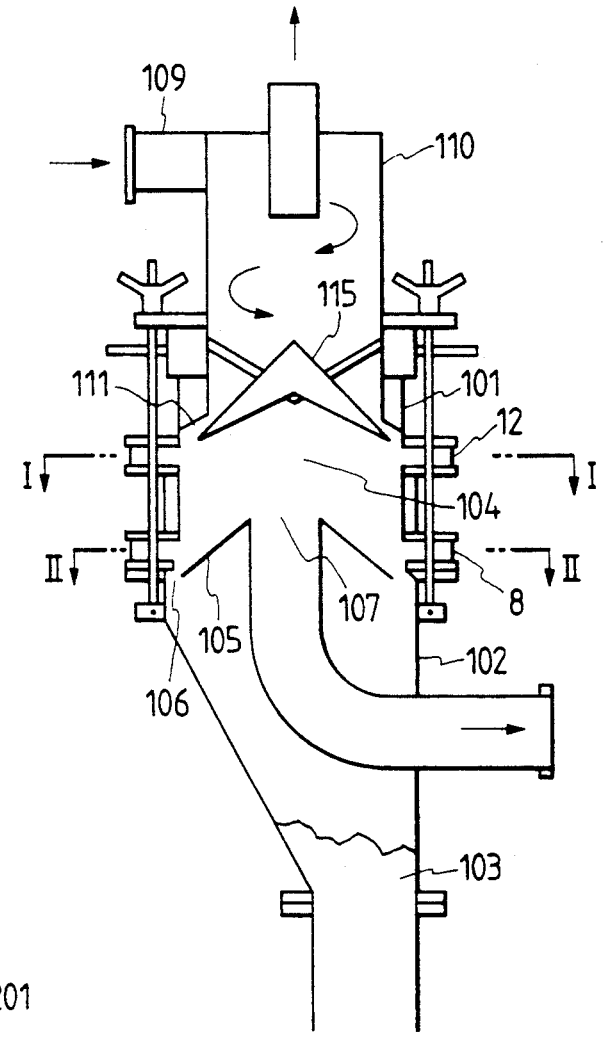

As another example of the gas current classifying separator of the present invention, one having a shape shown in FIG. 8 (outer surface view) and FIG. 9 (longitudinal front view), can be utilized. In FIG. 8 and FIG. 9, the classifying separator has a main body casing 101, a lower casing 102 connected to the lower portion of said casing 101 and a hopper 103 at the lower portion of the casing 102. A classifying chamber 104 is formed internally of the main body casing 101. At the upper portion of the main casing 101 is a guide cylinder 110, and at the upper peripheral surface of said guide cylinder 110 is connected a feeding cylinder 109. At the lower portion within the guide cylinder 110 is mounted a guide plate 115 having a slanted shape with a high central portion, and an annular feeding inlet 111 is formed at the lower brim outer periphery of the guiding plate 115. The diameter of the guide plate 115 is made larger than the inner diameter of the guide cylinder 110, whereby the powder feeding inlet 111 is formed at the outer peripheral portion of the guide plate 115, the inner wall of the main body casing 101 and the outermost peripheral portion of the classifying chamber 104.

At the bottom of the classifying chamber 104 is provided a slanted classifying plate 105 with a high central portion, and an annular coarse powder discharging outlet 106 is formed at the lower brim outer periphery of the classifying plate 105. A fine powder discharging outlet 107 is formed at the central portion of the classifying plate 105.

Figure 4B:
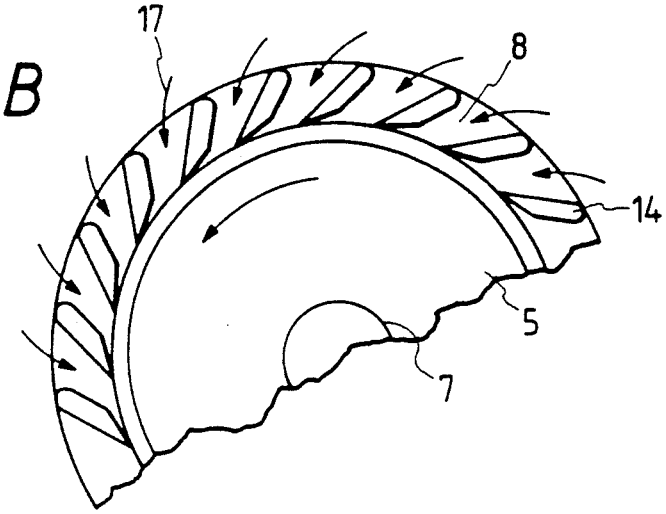

At the outer periphery of the lower surrounding wall of the classifying chamber 104 is equipped an air inflow inlet 8, and the air inflow inlet 8 is generally composed of the gaps between the blade-shaped classifying louvers 14 shown in FIG. 4. The current of the air introduced through the air inflow inlet 8 is controlled by the classifying louvers 14 so as to be jetted out in the whirling direction of the powder material descending while whirling in the classifying chamber 104 to disperse the powder material, and also accelerate the whirling speed.

According to the constitution of the present invention, by enlarging the diameter of the guide plate, the diameter of the annular feeding inlet 111 can be enlarged to make the distance to the fine powder discharging outlet 107 larger. Therefore, mixing of the coarse powder into the fine powder discharged through the fine powder discharging outlet 107 can be prevented to make the average particle size of the separated fine powder smaller. At the same time, the powder material concentrated by centrifugal force at the guide plate inner wall and flowing under whirling conditions through the annular feeding inlet 111 into the classifying chamber 104 can be dispersed by the gas current flowing through the air inlet 12 at the upper portion of the classifying chamber. Further, the whirling speed is further accelerated by the air flowing through the gas current inlet 8, whereby the powder can be classified with good efficiency into coarse powder and fine powder. In the classifying separator of the present invention shown in FIG. 9, by providing a gas inflow inlet 12 at the upper portion of the classifying chamber and increasing the whirling speed within the classifying chamber 104, the separted particle size can be made remarkably smaller along with the effect provided by the large guide plate as mentioned above.

Further, in the classifying separator of the present invention, by enlarging the diameter of the feeding inlet by enlarging the diameter of the guide plate; by providing air inflowing means for dispersing the powder material by a whirling current to the outer periphery of the upper portion of the classifying chamber; and further by making the orifice diameter of the fine powder discharging outlet 107 10% to 25% (more preferably 20% to 25%) of the outer diameter of the classifying plate (as 100%); and/or making the slanted angle of the classifying plate relative to the vertical direction of the classifying chamber 30° to 60° (more preferably 40° to 50°), classification with small separated particle size can be performed with good precision.

Figure 10:
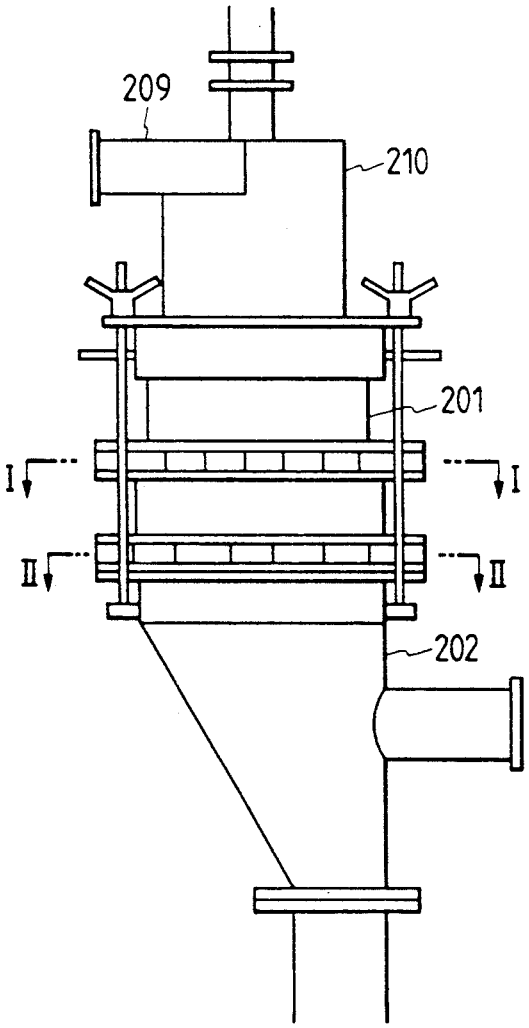
Figure 11:
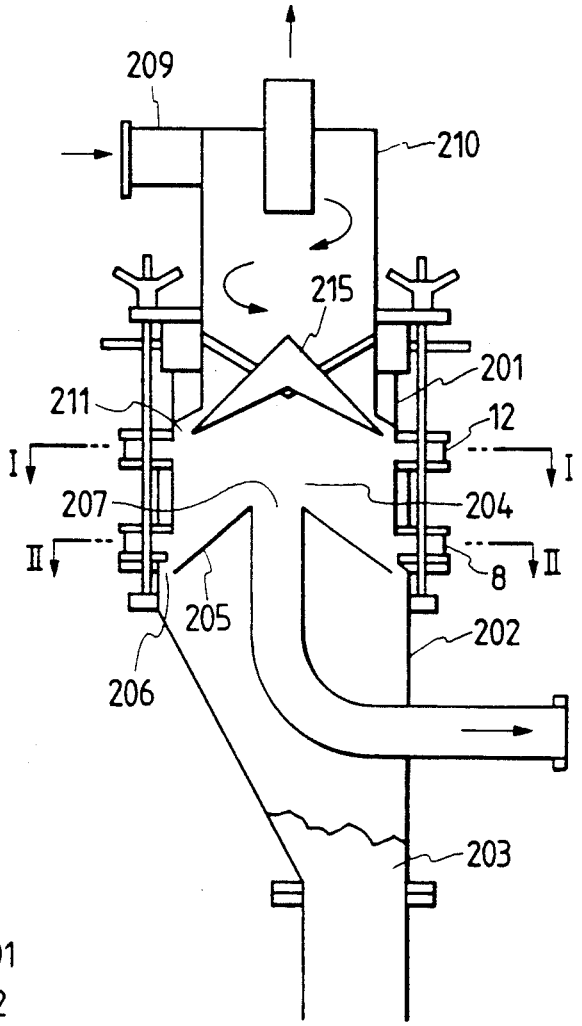
Figure 12:
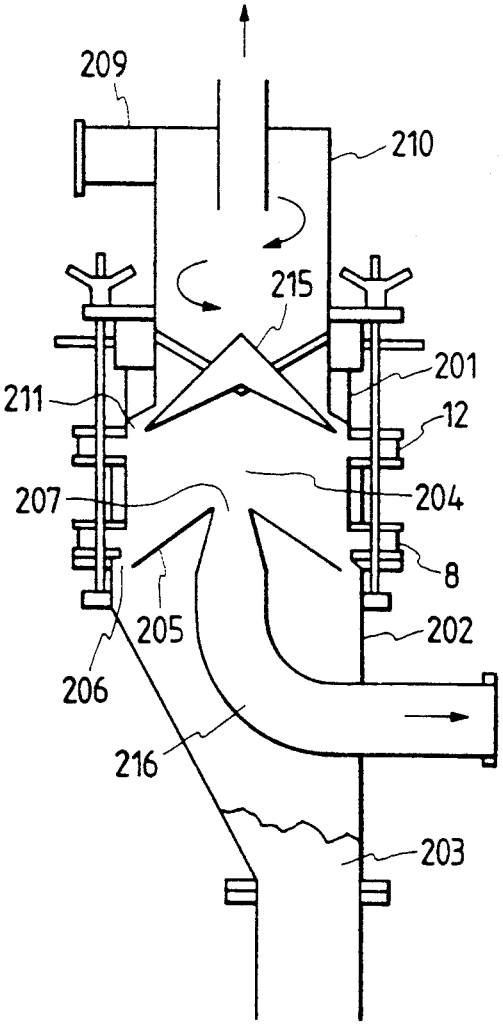
Figure 13:
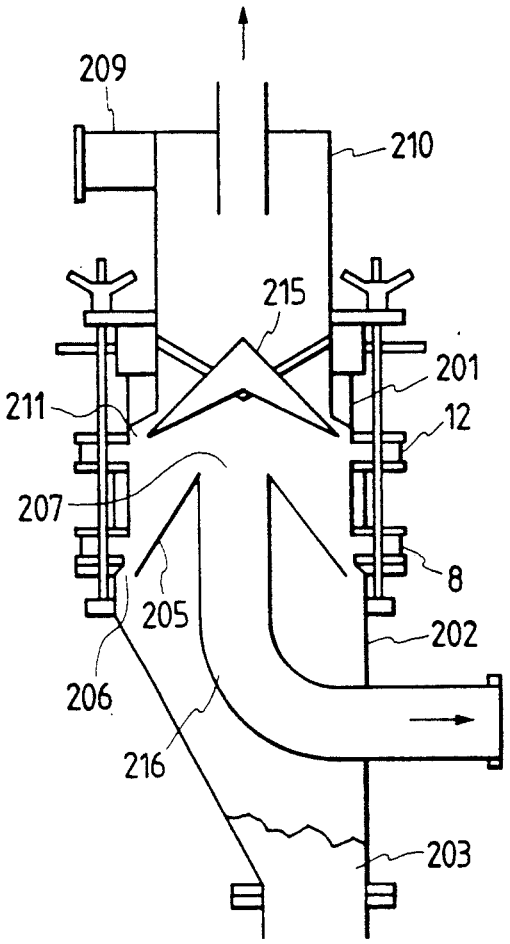
Figure 14:
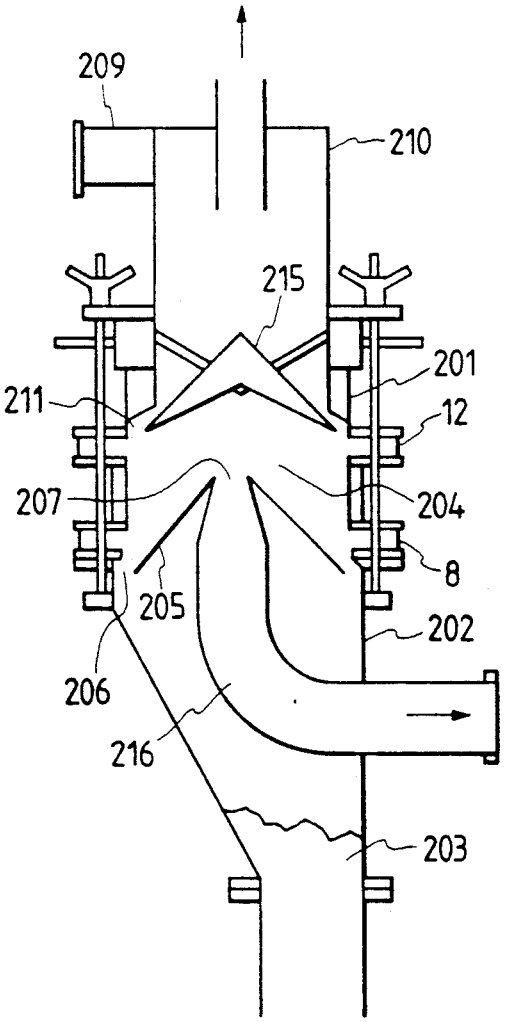
Figure 15A:
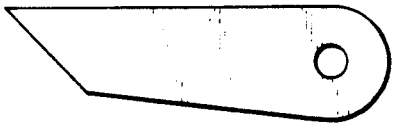
FIG. 15A shows a schematic plan view of a louver and FIG. 15B a schematic front view of the louver.
Figure 15B:
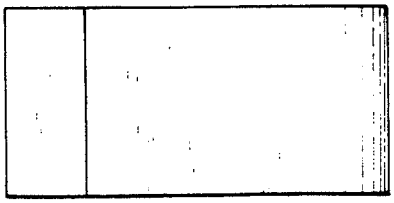

More specifically, one having a shape shown in FIG. 10 (outer surface view) and FIG. 11 (longitudinal front view), FIG. 12, FIG. 13 or FIG. 14 can be exemplified.

In the drawings, the classifying separator has a main body casing 201, a lower casing 202 connected to the lower portion of said casing 201, and a hopper 203 at the lower portion thereof, and a classifying chamber 204 is formed within the main body casing 201. At the upper portion of the main body casing 201 is standing a guide cylinder 210, and to the upper outer peripheral surface of the guide cylinder 210 is connected a feeding cylinder 209. At the internal bottom of the guide cylinder 210 is mounted a slanted guide plate 215 with a high central portion, and an annular feeding inlet 211 is formed at the lower brim outer periphery of the guide plate 215.

The diameter of the guide plate 215 is enlarged, whereby the feeding inlet 211 is formed by the outer peripheral portion of the guide plate 215, the inner wall of the main body casing 201 and the outermost peripheral portion of the classifying chamber 204.

At the bottom of the classifying chamber 204 is provided a slanted classifying plate 205 with a high central portion, and an annular coarse powder discharging outlet 206 is formed at the lower brim outer periphery of the classifying plate 205. A fine powder discharging outlet 207 is formed at the central portion of the classifying plate 205.

At the outer periphery of the surrounding wall at the lower portion of the classifying chamber 204 is equipped a gas inflow inlet 8 which is generally composed of the gaps between a plural number of blade-shaped classifying louvers 14 as shown in FIG. 14.

Further, at the outer periphery of the surrounding wall at the upper portion of the classifying 204 is equipped a gas inflow inlet 12.

Further, by making the orifice diameter of the fine powder discharging outlet 207 narrower than the inner diameter of the fine powder discharging pipe 216, and 10% to 25% of the outer diameter of the classifying plate 205, the distance from the outer periphery of the classifying plate 205 to the fine powder discharging outlet 207 can be enlarged to further prevent mixing of coarse powder into the separated fine powder, thereby making the average particle size of the classified powder smaller and its particle size distribution more precise.

The orifice diameter of the fine powder discharging outlet 207 should preferably be 20% to 25% of the outer diameter of the classifying plate 205. With a diameter less than 20%, the pressure loss becomes greater to reduce the amount of air passing through the fine powder discharging pipe 216, whereby the air causing dispersion and whirling flowing through the gas inflow inlets 8 and 12 is undesirably reduced.

Also, by making the slanted angle of the classifying plate 205 30° to 60°, the distance from the outer periphery of the classifying plate 205 to the fine powder discharging outlet 207 can be enlarged, whereby the same effect as obtained when making the orifice of the fine powder discharging outlet 207 smaller can be obtained.

In the classifying separator of the present invention, there is an extremely high tendency that the respective particles are sufficiently dispersed to primary particles within the classifying chamber, and therefore classifying efficiency is good, whereby the particle groups classified by the classifying separator of the present invention have precise particle size distributions and the classification efficiency is better as compared with the gas current classifying separator of the prior art. In the classifying separator of the present invention, it is also possible to make the desired separated particle size diameter smaller than that in the classifying separator of the prior art.

Figure 7:
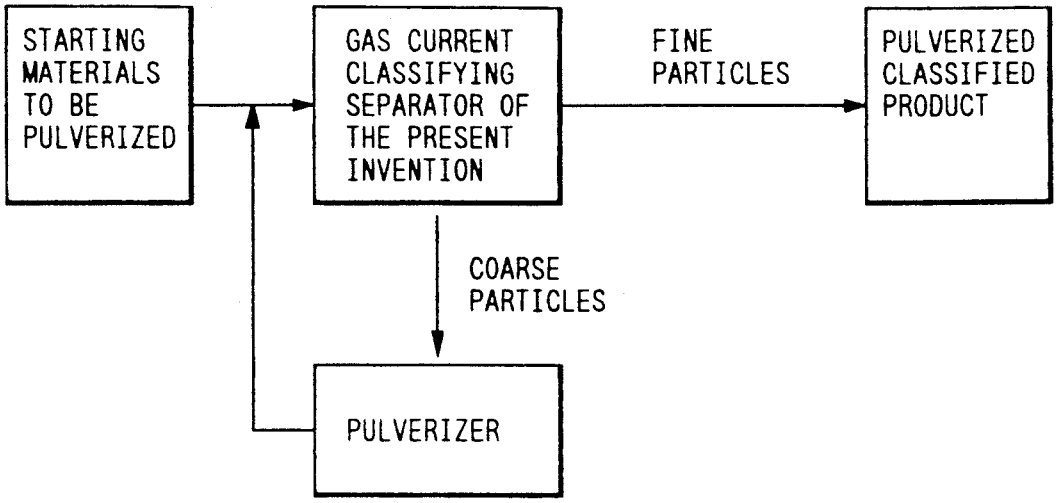
FIG. 7 is a flow chart of the pulverization-classification system in which the classifying separator according to the present invention is applied.

The gas current classifying separator of the present invention can be also effectively used by connecting to a pulverizer as shown in the flow chart in FIG. 7. In this case, the starting material to be pulverized is fed into the gas current classifying separator of the present invention, and coarse powder with a certain defined particle size or more is introduced into the pulverizer and, after pulverization, is again circulated to the gas current classifying separator. The particles pulverized in a defined particle size or less are taken out from the gas current classifying separtor by means of a suitable take-out means. In such pulverization-classification system, in the gas current classifying separator of the prior art system, dispersion of the powder within the classifying chamber is insufficient, and therefore it is difficult to separate or loosen the agglomerate constituted of very fine particles or fine particles attached to coarse powder. Such agglomerate was mixed to the coarse powder group side during classification, and circulated again into the pulverizer to cause excessive pulverization, thereby tending to bring about lowering in pulverization efficiency. To cope with such problems, in the gas current classifying separator of the present invention, since dispersion of the powder within the classifying chamber 4 is sufficiently effected, such agglomerate can be well loosened to be prevented from mixing into the coarse powder group and the fine powder particles are removed as fine powder, whereby pulverization efficiency can be further improved.

The classifying separator of the present invention has more marked effect as the particle size of the powder is smaller, and as the dust concentration in the classifying chamber is higher. Particularly, it is effective for the region with particle sizes of 10 μm or less, and may be more effective in the manner of use wherein it is bound with a pulverizer.

The classifying separator of the present invention is suitable for classification and preparation of a powder such as toner for development of electrostatic charges, powdery paint, magnetic material, polymeric material, etc. of which the final product is required to be fine particles. Particularly, it is suitable as the gas current classifying separator to be used for preparation of a toner for development of electrostatic charges which is liable to bear electrostatic force to be readily agglomerated.

The toner for development of electrostatic charges has the final product form of fine particles, and is required to have a precise particle size distribution from which a group of particles with a defined particle size or less has been removed. For removing a group of particles with a defined particle size or less, in the gas current classifying separator of the system shown in FIG. 5 or FIG. 6, classification precision was not yet satisfactory, and the product obtained tended to have a broad particle size distribution.

Even when a product with a precise particle size distribution may be obtained in a classifying separator of the prior art, lowering in classification efficiency results in increased cost. In contrast, by use of the classifying separator of the present invention, dispersion of the powder within the classifying chamber is effected sufficiently, and the coarse powder can be separated efficiently from the fine powder, whereby a classified product with precise particle distribution (for example, used as toner) can be formed without lowering yield.

The present invention is described in detail below by referring to Examples.

EXAMPLE 1

| | |
|---|---|
| Styrene-acrylate ester type resin (weight average molecular weight about 300,000) | 100 wt. parts |
| Magnetic ferrite (particle size 0.2 μm) | 60 wt. parts |
| Low molecular weight polyethylene | 2 wt. parts |
| Negatively chargeable controller | 2 wt. parts |

A toner starting material comprising a mixture of the above recipe was melted and kneaded at about 180° C. for about 1.0 hour, then solidified by cooling, coarsely pulverized by a hammer mill into particles of 100 to 1000 μ, and subsequently pulverized by a sonication jet mill manufactured by Nippon Pneumatic Kogyo K.K. to obtain a pulverized product (powder starting material) with a weight average particle size of 10.5 μm (containing 1 wt. % or less of particles with particle sizes of 20.2 μm or more and 9.3 wt. % of particles with particle sizes of 5.04 μm or less). The pulverized product was introduced into the gas current classifying separator shown in FIG. 1 and FIG. 2 for classification. In the gas current classifying separator, the pulverized product was aspirated with a wind amount of 5 $m^3$/min., and the gas inflow inlet 12 for inflowing air 16 had 20 openings of 2 cm×0.6 cm (total opening area $2\times0.6\times20=24$ $cm^2$) set by dispersing louvers 13. The gas inflow inlet 8 for inflowing gas 17 at the lower portion of the classifying chamber had 20 openings of 2 cm×0.2 cm (total opening area $2\times0.2\times20=8$ $cm^2$) set by classifying louvers 14, and the height of the classifying chamber was made 14 cm. The flow velocity of the gas 17 through the gas inflow inlet 8 was about twice as fast as the velocity of the gas 16 through the gas inflow inlet 12. As the result of classification of the pulverized product, a classified product preferable as toner with an average particle size of 11.5 μm (containing 0.3 wt. % of particles with sizes of 5.04 μm or less) was obtained as a classified product from which fine powder was removed with a classification yield of 81%. Here, the classification yield refers to the ratio of the weight of the classified product finally obtained to the total weight of the starting pulverized product supplied. The particle size data are measurement results obtained by Coulter Counter manufactured by Coulter Electronics.

COMPARATIVE EXAMPLE 1

Figure 5:
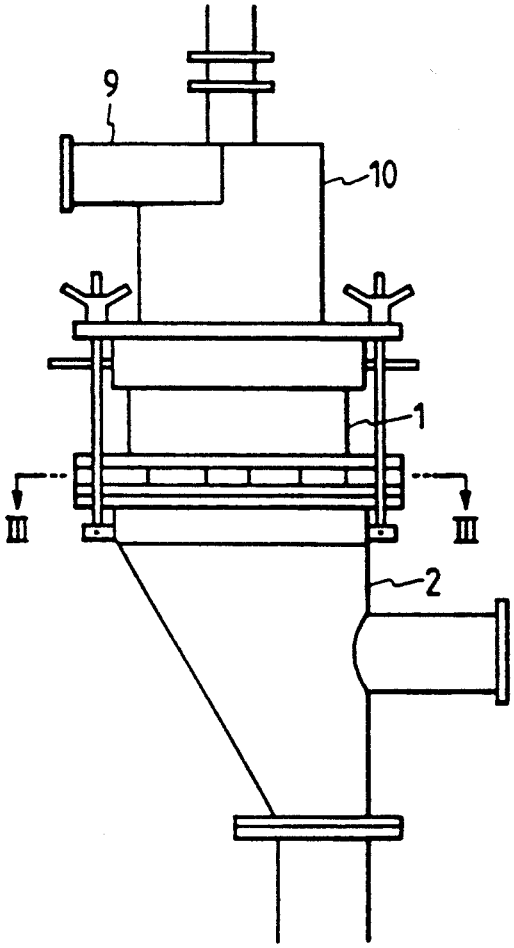
FIG. 5 PRIOR ART
FIG. 5 shows a schematic illustration of the outer surface of the gas current classifer of a prior art example, FIG. 6 its longitudinal front view.
Figure 6:
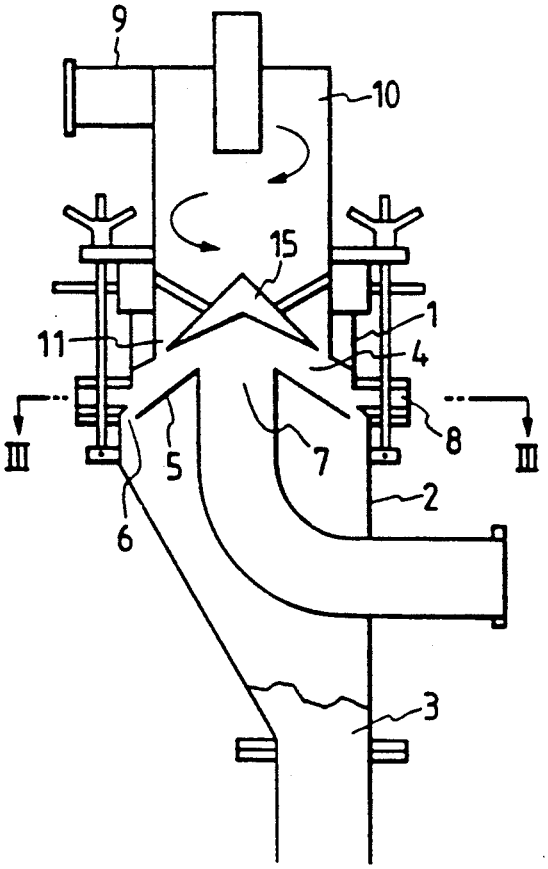
FIG. 6 PRIOR ART

The pulverized product obtained in the same manner as in Example 1 was introduced into a gas current classifying separator of the system shown in FIG. 5 and FIG. 6 for classification. The gas current classifying separator aspirated the powder with a wind amount of 5 $m^3$/min., with the gas inflow inlet at the bottom of the classifying chamber having 20 openings of 2 cm×0.2 cm and the height of the classifying chamber being made 10 cm. As the result of classification of the pulverized product, the product with a weight average particle size of 11.2 μm (containing 0.9 wt. % of particles with sizes of 5.04 μm or less) was obtained as the classified product from which fine powder was removed with a classification yield of 72%. The classification yield was inferior to that of Example 1, and further as the result of examination of the product, it was found that agglomerates of 5 μm or more with very fine particles being agglomerated existed in spots.

The results of Example 1 and Comparative example 1 are shown below in Table 1.

TABLE 1

| | Classification yield (wt. %) | Weight average particle size (μm) | Particle size distribution: Content of particles of 5.04 μm or less | Particle size distribution: Content of particles of 20.2 μm or more |
|---|---|---|---|---|
| Example 1 | 81 | 11.5 | 0.3 wt. % | 1.0 wt. % or less |
| Comparative example 1 | 72 | 11.2 | 0.9 | 1.0 or less |

The principal parts of the classifying separator used in Example 1 had the dimensions shown below.

The guide cylinder 10 had an inner diameter of about 29 cm, the discharging guide plate 15 an outer diameter of about 26 cm, the gas inflow inlet 12 and the gas inflow inlet 8 were apart by about 6 cm, the classifying plate 5 had an outer diameter of about 37 cm, the lower casing 2 opposed to the classifying plate 5 an inner diameter of about 42 cm, and the fine powder discharging outlet 7 of the classifying plate 5 an inner diameter of about 100 cm.

EXAMPLE 2

| | |
|---|---|
| Styrene-acrylate ester type resin (weight average molecular weight about 300,000) | 100 wt. parts |
| Magnetic ferrite (particle size 0.2 μm) | 60 wt. parts |
| Low molecular weight polyethylene | 2 wt. parts |
| Negatively chargeable controller | 2 wt. parts |

A toner starting material comprising a mixture of the above recipe was melted and kneaded at about 180° C. for about 1.0 hour, then solidified by cooling, coarsely pulverized by a hammer mill into particles of 100 to 1000 μ, and subsequently pulverized by a sonication jet mill manufactured by Nippon Pneumatic Kogyo K.K. to obtain a pulverized product with a weight average particle size of 7.0 μm (containing 1 wt. % or less of particles with particle sizes of 16 μm or more and 8.0 wt. % of particles with particle sizes of 4.0 μm or less). The pulverized product was introduced into the gas current classifying separator shown in FIG. 1 and FIG. 2 for classification. In the gas current classifying separator, the pulverized product was aspirated with a wind amount of 5 $m^3$/min., and the gas inflow inlet 12 had 20 openings of 2 cm×0.2 cm (total opening area $2\times0.2\times20=8$ $cm^2$) set by dispersing louvers 13. The gas inflowing inlet 8 at the bottom of the classifying chamber had 20 openings of 2 cm×0.1 cm (total opening area $2\times0.1\times20=4$ $cm^2$) set by classifying louvers 14, and the height of the classifying chamber was made 16 cm. As the result of classification of the pulverized product, a classified product with an average particle size of 7.5 μm (containing 2.0 wt. % of particles with sizes of 4.0 μm or less) was obtained as a classified product from which fine powder was removed with a classification yield of 78%.

COMPARATIVE EXAMPLE 2

The pulverized product obtained in the same manner as in Example 2 was introduced into a gas current classifying separator shown in FIG. 5 and FIG. 6 for classification. The gas current classifying separator aspirated the powder with a wind amount of 5 $m^3$/min., with the gas inflow inlet at the lower part of the classifying chamber having 20 openings of 2 cm×0.1 cm and the height of the classifying chamber being made 12 cm. As the result of classification of the pulverized product, the product with a weight average particle size of 7.3 μm (containing 4.1 wt. % of particles with sizes of 4.0 μm or less) was obtained as the classified product from which fine powder was removed with a classification yield of 70%. The classification yield was inferior to that of Example 2, and further as the result of examination of the product, it was found that agglomerates of 3 μm or more with very fine particles being agglomerated existed in spots.

The results of Example 2 and Comparative example 2 are shown below in Table 2.

TABLE 2

| | Classification yield (wt. %) | Weight average particle size (μm) | Particle size distribution: Content of particles of 4.0 μm or less | Particle size distribution: Content of particles of 16 μm or more |
|---|---|---|---|---|
| Example 2 | 78 | 7.5 | 2.0 wt. % | 1.0 wt. % or less |
| Comparative example 2 | 70 | 7.3 | 4.1 | 1.0 or less |

EXAMPLE 3

| | |
|---|---|
| Styrene-acrylate ester type resin (weight average molecular weight about 300,000) | 100 wt. parts |
| Magnetic ferrite (particle size 0.2 μm) | 60 wt. parts |
| Low molecular weight polyethylene | 2 wt. parts |
| Negatively chargeable controller | 2 wt. parts |

A toner starting material comprising a mixture of the above recipe was melted and kneaded at about 180° C. for about 1.0 hour, then solidified by cooling, coarsely pulverized by a hammer mill into particles of 100 to 1000μ, and subsequently pulverized by ACM pulverizer manufactured by Hosokawa Micron K.K. to obtain a pulverized product with a weight average particle size of 30 μm. The pulverized product was introduced into the gas current classifying separator for classification shown in FIG. 1 and FIG. 2, and micropulverization and classification were performed based on the flow chart shown in FIG. 7. As the pulverizing machine, a sonication jet mill I-5 Model manufactured by Nippon Pneumatic was employed, and in the gas current classifying separator, the pulverized product was aspirated with a wind amount of 5 $m^3$/min., and the gas inflowing inlet had 20 openings of 2 cm×0.2 cm (total opening area $2\times0.2\times20=8$ $cm^2$) set. The gas inflowing inlet at the lower portion of the classifying chamber had 20 openings of 2 cm×0.2 cm (total opening area $2\times0.2\times20=8$ $cm^2$) set, and the height of the classifying chamber was made 12 cm. The starting material (pulverized product) was fed at a rate of 40 kg/hour, and the product pulverized to the defined particle size or lower was taken out as fine powder.

The fine powder obtained was found to have a weight average particle size of 11.2 μm, 5.0 wt. % of particles with particle sizes of 5.04 μm or less and 0.5 wt. % of particles with particle sizes of 20.2 μm or more. From this fact, it can be seen that the coarse powder was precisely classified.

COMPARATIVE EXAMPLE 3

The pulverized product obtained in the same manner as in Example 3 was introduced into a gas current classifying separator shown in FIG. 5 and FIG. 6, and fine pulverization and classification were performed based on the flow chart shown in FIG. 7. As the pulverizer, a sonication jet mill I-5 Model manufactured by Nippon Pneumatic Kogyo K.K. was employed, and gas current classifying separator aspirated with a wind amount of 5 $m^3$/min., with the gas inflow inlet at the bottom of the classifying chamber having 20 openings of 2 cm×0.2 cm and the height of the classifying chamber being made 8 cm.

The starting material (pulverized product) was fed at a rate of 30 kg/hour, and the product pulverized to the defined particle size or lower was taken out as fine powder. The fine powder obtained was found to have a weight average particle size of 11.5 μm, 9.1 wt. % of particles with particle sizes of 5.04 μm or less and 5.1 wt. % of particles with particle sizes of 20.2 μm or more, thus being widely distributed on the coarse powder side.

The results of Example 3 and Comparative example 3 are shown below in Table 3.

TABLE 3

| | Classification yield (wt. %) | Weight average particle size (μm) | Particle size distribution: Content of particles of 5.04 μm or less | Particle size distribution: Content of particles of 20.2 μm or more |
|---|---|---|---|---|
| Example 3 | 40 | 11.2 | 5.0 wt. % | 0.5 wt. % |
| Comparative example 3 | 30 | 11.5 | 9.1 | 5.1 |

As can be clearly seen from the treated amounts in the above Table, the classifying separator of the present invention used in Example 3 was also excellent in treating capacity as compared with the classifying separator used in Comparative example 3.

EXAMPLE 4

Except for using the classifying separator shown in FIG. 8 and FIG. 9 as the gas current system classifying separator, in the same manner as in Example 3, fine powder with defined particle size (weight average particle size about 7.4 to 7.5 μm) was obtained as the classified product from the pulverized product. The results are shown below in Table 4. For reference, the results obtained when utilizing the system of Example 3 are shown together as Example 3A.

TABLE 4

| | Classification yield (wt. %) | Weight average particle size (μm) | Particle size distribution: Content of particles of 4.0 μm or less | Particle size distribution: Content of particles of 16 μm or more |
|---|---|---|---|---|
| Example 4 | 25 | 7.5 | 2.1 wt. % | 0.1 wt. % or less |
| Example 3A | 20 | 7.4 | 3.5 | 0.1 |

It can be seen that the classifying performance is improved by making the outer diameter of the guide plate 115 larger than the guide cylinder 101.

EXAMPLE 5

| | |
|---|---|
| Styrene-acrylate ester type resin | 100 wt. parts |
| Magnetic material | 60 wt. parts |
| Charge controller | 2 wt. parts |
| Low molecular weight polypropylene | 4 wt. parts |

A toner material comprising the above formulation was kneaded by heating, cooled and then coarsely pulverized by a hammer mill. The starting powder obtained was charged into a gas current classifying separator shown in FIG. 10 and FIG. 11 (orifice diameter ratio of fine powder discharging outlet 207 to classifying plate 205: about 24%, slanted angle of classifying plate: 60°), and the separated coarse powder was permited to inflow into a sonication jet mill I-10 Model (manufactured by Nippon Pneumatic Kogyo K.K.) connected to said classifying separator to effect fine pulverization (jet air pressure for pulverization: 6 kgf/cm$^2$), and the fine material micropulverized was again charged together with the powder material obtained by coarse pulverization into said classifying separator to obtain the separated fine powder as the micropulverized product (see the pulverization-classification system in FIG. 7).

As the result, a fine pulverized product with a weight average particle size of 14.3 μm and a content of particles with particle sizes of 20 μm or more of 6.2 wt. % was obtained.

EXAMPLE 6

In the same manner as in Example 5, the powder material was charged into the gas current classifying separator shown in FIG. 12, and a finely micropulverized product was obtained under a jet air pressure for pulverization of 6 kgf/cm$^2$.

As the result, a fine pulverized product with a weight average particle size of 12.6 μm and a content of particles with particle sizes of 20 μm or more of 1.8 wt. % was obtained.

The gas current classifying separator shown in FIG. 12 has the fine powder discharging orifice shown in FIG. 11 which has an orifice diameter of 20% of the outer diameter of the classifying plate.

EXAMPLE 7

In the same manner as in Example 5, the powder material was charged into the gas current classifying separator shown in FIG. 13, and a finely micropulverized product was obtained under a jet air pressure for pulverization of 6 kgf/cm$^2$.

As the result, a fine pulverized product with a weight average particle size of 12.1 μm and a content of particles with particle sizes of 20 μm or more of 1.5 wt. % was obtained.

The gas current classifying separator shown in FIG. 13 has the classifying plate shown in FIG. 11 which is slanted at an angle of 50°.

EXAMPLE 8

In the same manner as in Example 5, the powder material was charged into the gas current classifying separator shown in FIG. 14, and a finely micropulverized product was obtained under a jet air pressure for pulverization of 6 kgf/cm$^2$.

As the result, a fine pulverized product with a weight average particle size of 10.4 μm and a content of particles with particle sizes of 20 μm or more of 0 wt. % was obtained.

The gas current classifying separator shown in FIG. 14 has the fine powder discharging orifice shown in FIG. 11 which has an orifice diameter of 20% of the outer diameter of the classifying plate, and the classifying plate shown in FIG. 11 is slanted by an angle of 50°.

EXAMPLE 9

In the same manner as in Example 8 except for using the system having a sonication jet mill I-5 Model (produced by Nippon Pneumatic Kogyo K.K.) connected to the gas current classifying separator shown in FIG. 14, a fine pulverized product was obtained from the starting powder.

As the result, a fine pulverized product with a weight average particle size of 4.6 μm and a content of particles with particle sizes of 10 μm or more of 0.1 wt. % was obtained.

The gas current classifying separator used here has a classifying chamber which has a diameter made 80% of that (about 42 cm) of the classifying chamber in the classifying separator used in Example 8.

COMPARATIVE EXAMPLE 4

In the same manner as in Example 5 except for using the gas current classifying separator having no gas inflowing inlet 12 as shown in FIG. 5 and FIG. 6, a fine pulverized product was obtained. Said product was found to have a weight average particle size of 18.3 μm and a content of particles with particle sizes of 20 μm or more of 12.1 wt. %, thus being widely distributed on the coarse powder side. In the case of the same feeding amount as in Example 5, the particle size distribution was found to be broader.

COMPARATIVE EXAMPLE 5

When a fine pulverized product was obtained under a jet air pressure for pulverization of 6 kgf/cm$^2$ by charging the starting powder into a gas current classifying separator as shown in FIG. 5 and FIG. 6 having the same classification chamber diameter as in Example 9, its particle size distribution was a weight average particle size of 5.8 μm and a content of the particles with particle sizes of 10.8 μm or more of 5.0 wt. %.

As described above, by enlarging the diameter of the feeding groove by enlarging the diameter of the guide plate, providing a gas inflowing means for dispersing the powder material to the upper outer periphery of the classifying chamber by whirling current, and further by making smaller the orifice diameter of the fine powder discharging outlet and/or making slanting of the classifying plate a steep gradient, a classified product with small separated particle size and precise distribution can be obtained with good efficiency.

What is claimed is:

1. A separator for classifying powder with air current, comprising:

a classifying chamber and an introducing means for introducing powder into said classifying chamber;

a powder feeding inlet for feeding powder formed at an upper portion of said classifying chamber;

a cone-shaped classifying plate with a high central portion disposed at a lower portion of said classifying chamber;

a coarse powder discharging outlet for discharging a coarse powder group disposed at a lower outer periphery of said classifying plate;

a fine powder group discharging outlet for discharging downwardly a fine powder group disposed at a central portion of said classifying plate;

gas inflowing means for dispersing powder by whirling gas provided at an upper outer periphery of said classifying chamber wherein air flows into said classifying chamber through an opening area in said gas inflowing means to disperse and accelerate the powder; and a gas inflow inlet for creating a whirling current of gas for classifying powder provided at the lower portion of said classifying chamber, wherein air flows into said classifying chamber through an opening area in said gas inflow inlet to classify powder in the course powder group and the fine powder group, wherein when the total sum of the opening area of said gas inflowing means for introducing gas into said classifying chamber at the upper portion of said classifying chamber is represented by A and the total sum of the opening area of said glass inflow inlet for introducing gas for classifying powder at the lower portion of said classifying chamber is represented by B, and said total sum A and said total sum B satisfy the following formula:

$$1 \leqq A/B \leqq 20,$$

and the flow velocity of the gas flowing from said gas inflowing means at the upper portion of said classifying chamber is substantially equal to or slower than the velocity of the gas flowing from said gas inflow inlet at the lower portion of said classifying chamber.

2. A separator according to claim 1, wherein said gas inflowing means is provided at a level higher than one-half of the total height of said classifying chamber.

3. A separator acording to claim 1, wherein said gas inflowing means is formed of louvers.

4. A separator according to claim 1, wherein said gas inflow inlet is formed of louvers.

5. A separator according to claim 1, wherein said classifying chamber is formed internally of a main body casing, and a guide cylinder for introducing powder to be classified into said classifying chamber is provided at an upper portion of said main body casing.

6. A separator according to claim 5, wherein said classifying chamber is formed between a guide plate and said classifying plate.

7. A separator according to claim 6, wherein the outer diameter of said guide plate is larger than the inner diameter of said guide cylinder, and an annular powder feeding inlet is defined by an outer brim portion of said guide plate and an inner wall of said guide plate and an inner wall of said main body casing.

8. A separator according to claim 1, wherein said classifying plate has a circular fine powder discharging outlet having a diameter which is 10 to 25% of the outer diameter of said classifying plate.

9. A separator according to claim 1, wherein said classifying plate has a circular fine powder discharging outlet having a diameter which is 20 to 25% of the outer diameter of said classifying plate.

10. A separator according to claim 1, wherein said classifying plate has a slanted angle of 30° to 60° relative to the vertical direction of said classifying chamber.

11. A separator according to claim 1, wherein said classifying plate has a slanted angle of 40° to 50° relative to the vertical direction of said classifying chamber.

* * * * *

UNITED STATES PATENT AND TRADEMARK OFFICE

CERTIFICATE OF CORRECTION

PATENT NO. : 5,165,549

DATED : November 24, 1992

INVENTOR(S) : Hitoshi Kanda, et al.

It is certified that error appears in the above-identified patent and that said Letters Patent is hereby corrected as shown below:

COLUMN 1:

Line 16, "powder starting" should read --starting powder--
Line 37, "point, to and" should read --point, and--.

COLUMN 3:

Line 28, "a" (second occurrence) should be deleted.

COLUMN 7:

Line 28, "classifying 204" should read --classifying chamber 204--.

COLUMN 12:

Line 29, "classification yield (wt. %)" should read --Amount treated (kg/hour)--.
Line 57, "classification yield (wt. %)" should read --Amount treated (kg/hour)--.

COLUMN 15:

Line 22, "glass" should read --gas--.

UNITED STATES PATENT AND TRADEMARK OFFICE

CERTIFICATE OF CORRECTION

PATENT NO. : 5,165,549 Page 2 of 2

DATED : November 24, 1992

INVENTOR(S) : Hitoshi Kanda, et al.

It is certified that error appears in the above-identified patent and that said Letters Patent is hereby corrected as shown below:

COLUMN 16:

Line 4, "acording" should read --according--.

Signed and Sealed this

Fourth Day of January, 1994

Bruce Lehman

*Attest:*

BRUCE LEHMAN

*Attesting Officer*

*Commissioner of Patents and Trademarks*